US010372074B2

(12) United States Patent
Oyama

(10) Patent No.: US 10,372,074 B2
(45) Date of Patent: Aug. 6, 2019

(54) SHEET CONVEYOR AND IMAGE FORMING APPARATUS

(71) Applicant: Brother Kogyo Kabushiki Kaisha, Nagoya (JP)

(72) Inventor: Yoshihiro Oyama, Tokai (JP)

(73) Assignee: Brother Kogyo Kabushiki Kaisha, Nagoya-Shi (JP)

( * ) Notice: Subject to any disclaimer, the term of this patent is extended or adjusted under 35 U.S.C. 154(b) by 302 days.

(21) Appl. No.: 15/469,788

(22) Filed: Mar. 27, 2017

(65) Prior Publication Data

US 2017/0277101 A1 Sep. 28, 2017

(30) Foreign Application Priority Data

Mar. 28, 2016 (JP) ..... 2016-063588

(51) Int. Cl.

| | |
|---|---|
| ***B65H 5/06*** | (2006.01) |
| ***G03G 15/00*** | (2006.01) |
| *G03G 15/23* | (2006.01) |
| *B65H 85/00* | (2006.01) |

(52) U.S. Cl.

CPC ..... *G03G 15/65* (2013.01); *B65H 5/06* (2013.01); *G03G 15/6573* (2013.01); *B65H 85/00* (2013.01); *G03G 15/232* (2013.01); *G03G 15/234* (2013.01); *G03G 15/6529* (2013.01); *G03G 15/6579* (2013.01)

(58) Field of Classification Search

None

See application file for complete search history.

(56) References Cited

FOREIGN PATENT DOCUMENTS

| | | | |
|---|---|---|---|
| JP | H02-291358 | A | 12/1990 |
| JP | 2003-137472 | A | 5/2003 |
| JP | 2006-248723 | A | 9/2006 |
| JP | 2009-102148 | A | 5/2009 |

*Primary Examiner* — Jill E Culler

(74) *Attorney, Agent, or Firm* — Burr & Brown, PLLC

(57) ABSTRACT

A sheet conveyer, comprising: a 1st conveying roller; a 1st support part to support the 1st conveying roller; a 1st helical gear to rotate together with the 1st conveying roller and to generate thrust in a particular direction; a 2nd conveying roller; a 2nd support part to support the 2nd conveying roller; a 2nd helical gear to generate thrust in the particular direction; a 3rd helical gear to engage with the 1st helical gear; a 4th helical gear to engage with the 2nd helical gear; and a clutch to connect or disconnect transmission of a driving force between the 3rd helical gear and the 4th helical gear, wherein: when the clutch is disconnected, the 1st and 2nd conveying rollers are disposed at an initial position, and when the clutch is connected, the 1st and 2nd conveying rollers move from the initial position in the particular direction.

5 Claims, 6 Drawing Sheets

SHEET CONVEYOR AND IMAGE FORMING APPARATUS

CROSS-REFERENCE TO RELATED APPLICATION

This application claims priority under 35 U.S.C. § 119 from Japanese Patent Application No. 2016-063588, filed on Mar. 28, 2016. The entire subject matter of the application is incorporated herein by reference.

BACKGROUND

Technical Field

Aspects of the present disclosure relate to an image forming apparatus and a sheet conveyer for conveying a sheet.

Related Art

Image forming apparatuses having a sorter function are known.

SUMMARY

In a conventional image forming apparatus, it is necessary to tentatively stop a motor for driving a shaft and to reversely rotate the motor to move a roller so that the sorter function is realized. Therefore, in the conventional image forming apparatus, more time is required to execute the sorter function in comparison with the case of discharging a sheet without executing the sorter function. Furthermore, since the conventional image forming apparatus is configured such that the roller is moved when the shaft is reversely rotated, a problem arises that a configuration where the shaft is reversely rotated to perform double side printing cannot be used.

Aspects of the present disclosure are advantageous in that they provide at least one of a sheet conveyer and an image forming apparatus capable of conveying a sheet in a same conveying direction and a same required time when a sheet is to be shifted as those defined when a sheet is not to be shifted.

According to an aspect of the present disclosure, there is provided a sheet conveyer, comprising: a 1st conveying roller configured to rotate about a 1st rotation axis by a driving force from a driving source; a 1st support part configured to support the 1st conveying roller; a 1st helical gear configured to rotate about the 1st rotation axis together with the 1st conveying roller and to generate thrust, on the 1st support part, in a particular direction along the 1st rotation axis; a 2nd conveying roller disposed at a position where a conveying surface of the 2nd conveying roller faces a conveying surface of the 1st conveying roller, the 2nd conveying roller being configured to be rotatable about a 2nd rotation axis parallel with the 1st rotation axis; a 2nd support part configured to support the 2nd conveying roller; a 2nd helical gear configured to generate thrust, on the 2nd support part, in the particular direction; a 3rd helical gear configured to engage with the 1st helical gear; a 4th helical gear configured to engage with the 2nd helical gear; and a clutch configured to connect or disconnect transmission of a driving force between the 3rd helical gear and the 4th helical gear. In this configuration, when the clutch disconnects transmission of the driving force between the 3rd helical gear and the 4th helical gear, the 1st conveying roller and the 2nd conveying roller are disposed at an initial position. When the clutch connects transmission of the driving force between the 3rd helical gear and the 4th helical gear, the 1st conveying roller and the 2nd conveying roller move from the initial position in the particular direction.

BRIEF DESCRIPTION OF THE ACCOMPANYING DRAWINGS

DETAILED DESCRIPTION

It is noted that various connections are set forth between elements in the following description. It is noted that these connections in general and, unless specified otherwise, may be direct or indirect and that this specification is not intended to be limiting in this respect. Aspects of the present disclosure may be implemented on circuits (such as application specific integrated circuits) or in computer software as programs storable on computer-readable media including but not limited to RAMs, ROMs, flash memories, EEPROMs, CD-media, DVD-media, temporary storage, hard disk drives, floppy drives, permanent storage, and the like.

(Overall Configuration of Image Forming Apparatus)

Figure 1:
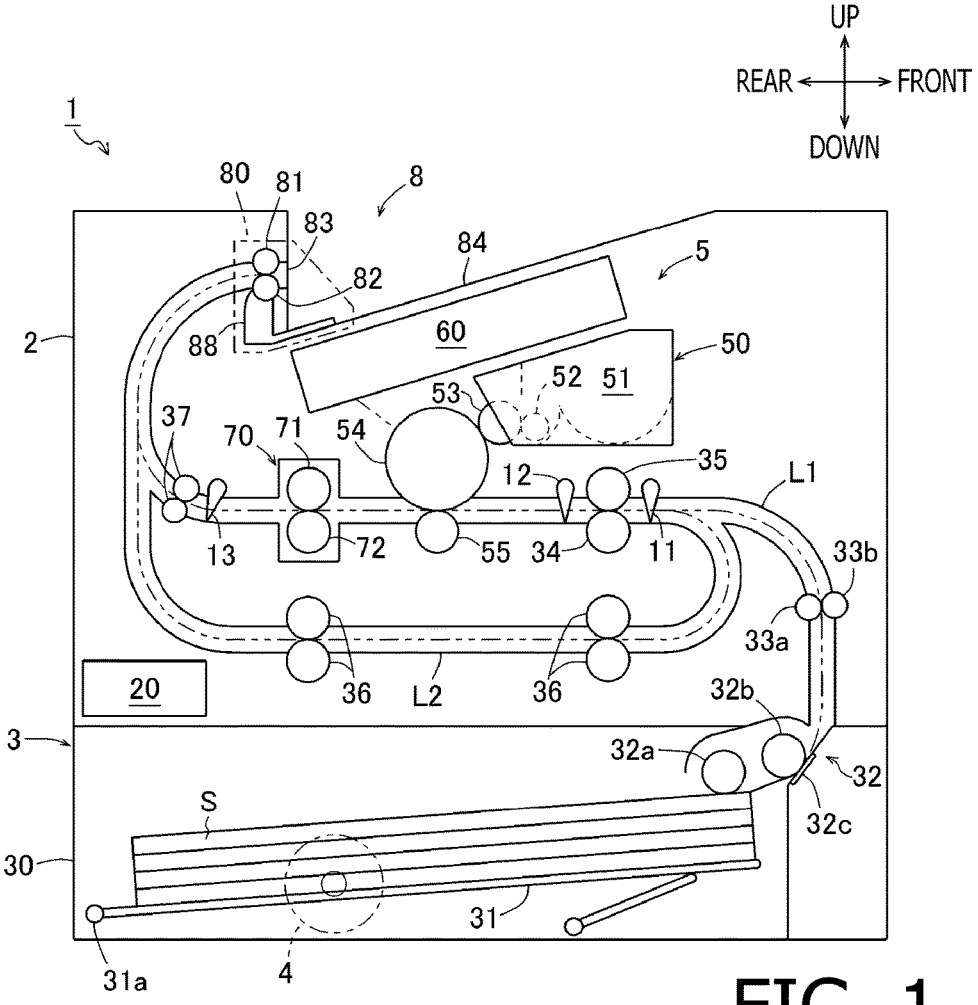
FIG. 1 is a central cross sectional view of an image forming apparatus according to an illustrative embodiment.

Hereafter, an image forming apparatus 1 according to an illustrative embodiment is described. In the following, the front and rear direction, the left and right direction and the up and down direction are defined based on a state where the image forming apparatus 1 is installed to be usable as shown in FIG. 1. The image forming apparatus 1 includes a housing 2, a supply unit 3, a motor 4, an image forming unit 5 and a discharge unit 8.

The supply unit 3 is disposed in a lower portion of the image forming apparatus 1, and conveys a sheet S held on the supply unit 3 to the image forming unit 5. The image forming unit 5 is disposed on a downstream side in a conveying direction of the sheet 2 with respect to the supply unit 3, and forms an image on the sheet S conveyed from the supply unit 3. The discharge unit 8 is disposed on a downstream side in the conveying direction of the sheet S with respect to the image forming unit 5. The discharge unit 8 discharges the sheet S conveyed from the image forming unit 5 to the outside or re-conveys the sheet S to the image forming unit 5.

The supply unit 3 includes a sheet cassette 30, a feeding mechanism 32, a conveying roller 33*a* and a registration roller 34.

The sheet cassette 30 is attached to a lower portion of the housing 2 such that the sheet cassette 30 is detachably attachable to the lower portion of the housing 2. The sheet cassette 30 is configured to be movable between an attached position at which the sheet cassette 30 is attached to the housing 2 and a separated position at which the sheet cassette 30 has been pulled to the front side of the housing 2. The sheet cassette 30 includes a pressure plate 31. The sheet cassette 30 is able to move the sheet S in the up and down direction by causing the pressure plate 31 to swing in the up and down direction about a rotation center 31*a* with a driving force from the motor 4. In accordance with a swing motion of the pressure plate 31 toward the upper side, the sheet S stacked on the pressure plate 31 is lifted to a paper supply position at which the sheet S can be supplied.

The feeding mechanism 32 separates and picks up one by one the sheet S held on the sheet cassette 30 and conveys the sheet S toward the conveying roller 33*a*. The feeding mechanism 32 includes a pickup roller 32*a*, a separation roller 32*b* and a separation pad 32*c*.

The pickup roller 32*a* is a roller for picking up the sheet S lifted up to the paper supply position by the pressure plate 31, and is disposed on the upper side with respect to a front end portion of the pressure plate 31. The separation roller 32*b* is disposed on a downstream side in the conveying direction of the sheet S with respect to the pickup roller 32*a*. The separation pad 32*c* is disposed to face the separation roller 32*b* and is pressed against the separation roller 32*b*.

The sheet S picked up by the pickup roller 32*a* is sent toward the separation roller 32*b*, and is separated one by one between the separation roller 32*b* and the separation pad 32*c*. In the image forming apparatus 1, a conveying path L1 is formed to extend from the feeding mechanism 32 to the discharge unit 8 via the image forming unit 5. Each separated sheet S is conveyed along the conveying path L1 toward the conveying roller 33*a*.

The conveying roller 33*a* is a roller that applies a conveying force to the sheet S, and is disposed on a downstream side in the conveying direction of the sheet S with respect to the feeding mechanism 32. At a position facing the conveying roller 33*a*, a paper dust removing roller 33*b* is disposed. The sheet S conveyed from the feeding mechanism 32 to the conveying roller 33*a* is pinched by the conveying roller 33*a* and the paper dust removing roller 33*b*, and is conveyed to the registration roller 34 along the conveying path L1.

The registration roller 34 is disposed on a downstream side in the conveying direction of the sheet S with respect to the conveying roller 33*a*. The registration roller 34 restricts movement of the leading edge of the sheet S between the registration roller 34 and a roller 35 disposed to face the registration roller 34 by tentatively stopping the sheet S so that the position of the sheet S is corrected. Subsequently, at an appropriate timing, the registration roller 34 conveys the sheet S to a transferring position.

On an upstream side in the conveying direction of the sheet S with respect to the registration roller 34, a pre-registration sensor 11 is disposed. On a downstream side in the conveying direction of the sheet S with respect to the registration roller 34, a post-registration sensor 12 is disposed. The pre-registration sensor 11 and the post-registration sensor 12 are sensors for detecting presence/absence of the sheet S at respective positions of pre-registration sensor 11 and the post-registration sensor 12.

The registration roller 34 starts rotating after a particular time has elapsed from a time when the leading edge of the sheet S being conveyed in the conveying direction along the conveying path L1 reaches the position of the pre-registration sensor 11, and stops rotating after a particular time has elapsed from a time when the trailing edge of the sheet S in the conveying direction reaches the position of the post-registration sensor 12.

The image forming unit 5 includes a process cartridge 50 which transfers an image to a surface of the sheet S conveyed from the supply unit 3, an exposing unit 60 which exposes a surface of a photosensitive drum 54 in the process cartridge 50, and a fixing unit 70 which fixes the image transferred to the sheet S by the process cartridge 50.

The process cartridge 50 is disposed on an upper side with respect to the supply unit 3 in the housing 2. The process cartridge 50 includes a supply roller 52, a development roller 53, the photosensitive drum 54 and a transfer roller 55.

The exposure unit 60 includes a laser diode, a polygonal mirror, a lens, and a reflection mirror, and is configured to expose the surface of the photosensitive drum 54 by emitting laser light based on image data input to the image forming apparatus 1 toward the photosensitive drum 54.

In a developer chamber 51, toner serving as developer is stored. The toner stored in the developer chamber 51 is sent to the supply roller 52 while being agitated by an agitating member (not shown). The supply roller 52 supplies the toner sent from the developer chamber 51 to the development roller 53.

The development roller 53 is disposed to closely contact the supply roller 52, and is configured to hold the toner which has been supplied from the supply roller 52 and has been positively charged by a slide contact member (not shown). To the development roller 53, a positive development bias is applied by a bias applying unit (not shown).

The photosensitive drum 54 is disposed adjoiningly with respect to the development roller 53. After the surface of the photosensitive drum 54 is charged positively and uniformly by a charger (not shown), the surface of the photosensitive drum 54 is exposed by the exposing unit 60. A potential of the exposed portion of the photosensitive drum 54 becomes lower than the other portion of the photosensitive drum 54, and thereby an electrostatic latent image is formed on the photosensitive drum 54. By supplying the positively charged toner from the development roller 53 to the surface of the photosensitive drum 54, the electrostatic latent image is developed and thereby a developer image is formed.

The transfer roller 55 is disposed to face the photosensitive drum 54. To the transfer roller 55, a negative transfer bias is applied by a bias applying unit (not shown). By letting the sheet S be conveyed between the transfer roller 55 and the photosensitive drum 54 on which the developer image is formed in a state where the transfer bias is applied to the surface of the transfer roller 55, the developer image formed on the surface of the photosensitive drum 54 is transferred to the surface of the sheet S.

The fixing unit 70 includes a heat roller 71 and a pressure roller 72. The heat roller 71 is rotated by a driving force from the motor 4, and is heated by supplying electric power thereto from a power supply source (not shown). The pressure roller 72 is disposed to face and closely contact the heat roller 71 to rotate in accordance with rotation of the heat roller 71. When the sheet S to which the developer image has been transferred is conveyed to the fixing unit 70, the fixing unit 70 conveys the sheet S while pinching the sheet S between the heat roller 71 and the pressure roller 72 so that the developer image is fixed on the sheet S.

On a downstream side in the conveying direction of the sheet S with respect to the fixing unit 70 and on an upstream side in the conveying direction with respect to a junction with a reverse path L2, a pair of conveying rollers 37 is disposed. The sheet S which has conveyed to the conveying rollers 37 from the fixing unit 70 is pinched by the conveying rollers 37, and is conveyed to a switchback drive roller 81 along the conveying path L1.

On an upstream side in the conveying direction of the sheet S with respect to the conveying rollers 37, a discharge sensor 13 is disposed. The discharge sensor 13 is a sensor for detecting presence/absence of the sheet S at the position of the discharge sensor 13. For example, a photo sensor may be used as the discharge sensor 13. The discharge sensor 13 may be used to detect that the sheet S has passed the conveying rollers 37. Specifically, it can be determined that the sheet S has passed the conveying rollers 37 after a particular time has elapsed from a time when the trailing edge of the sheet S being conveyed along the conveying path L1 has reached the position of the discharge sensor 13.

The discharge unit 8 includes the switchback drive roller 81, a switchback roller 82, a discharge port 83 and a discharge tray 84.

The switchback drive roller 81 and the switchback roller 82 are configured to be able to discharge the sheet S to the outside while pinching the sheet S being conveyed from the fixing unit 70 along the conveying path L1. The discharge tray 84 is formed on the upper surface of the housing 2. To the discharge tray 84, the sheet S discharged to the outside of the housing 2 through the discharge port 83 is stacked.

The switchback drive roller 81 is rotated by a driving force from the motor 4, and is configured to be able to rotate in a reverse direction with respect to a forward direction used to convey the sheet S toward the discharge tray 84. That is, the switchback drive roller 81 is able to rotate in one of a forward rotation mode in which the sheet S sent from the image forming unit 5 is conveyed toward the discharge tray 84 and a reverse rotation mode in which the sheet S sent from the image forming unit 5 is reversed and is re-conveyed toward the image forming unit 5.

The switchback drive roller 81 rotates in the forward rotation mode when the motor 4 rotates in the forward direction, and rotates in the reverse rotation mode when the motor 4 rotates in the reverse direction.

The discharge unit 8 includes a sorter mechanism 80 including the switchback drive roller 81 and the switchback roller 82. The sorter mechanism 80 serves as a component of a sheet conveyer in the image forming apparatus 1. The sorter mechanism 80 provides the sorter function. The sorter function is the function of shifting a discharge position of the sheet S in the width direction, and is used to provide a mark representing separation of, for example, print jobs. The sorter mechanism 80 is configured to move the switchback drive roller 81 and the switchback roller 82 in the left and right direction while pinching the sheet S between the switchback drive roller 81 and the switchback roller 82.

In the image forming apparatus 1, the reverse path L2 is formed under the image forming unit 5. The sheet S being conveyed by the switchback drive roller 81 rotated in the reverse direction is re-conveyed toward the image forming unit 5 along the reverse path L2. The sheet S being conveyed along the reverse path L2 is further conveyed toward the image forming unit 5 by conveying rollers 36 and 36 provided on the reverse path L2.

The reverse path L2 branches from the conveying path L1 between the conveying roller 37 and the switchback drive roller 81, and joins the conveying path L1 between the conveying roller 33*a* and the registration roller 34 provided on the conveying path L1.

The image forming apparatus 1 is configured to perform so-called double side printing in which the sheet S which has been sent from the fixing unit 70 and for which image forming has been performed on one side of the sheet S is re-conveyed to the image forming unit 5 through the reverse path L2.

Rotation in the forward direction, rotation in the reverse direction, and stopping of rotation of the motor 4 is controlled by a controller 20 provided in the image forming apparatus 1. The controller 20 controls rotational motion of the motor 4 based on, for example, signals from the pre-registration sensor 11, the post-registration sensor 12 and the discharge sensor 13. Further, the controller 20 controls the sorter function.

(Configuration of Sorter Mechanism)

Figure 2:
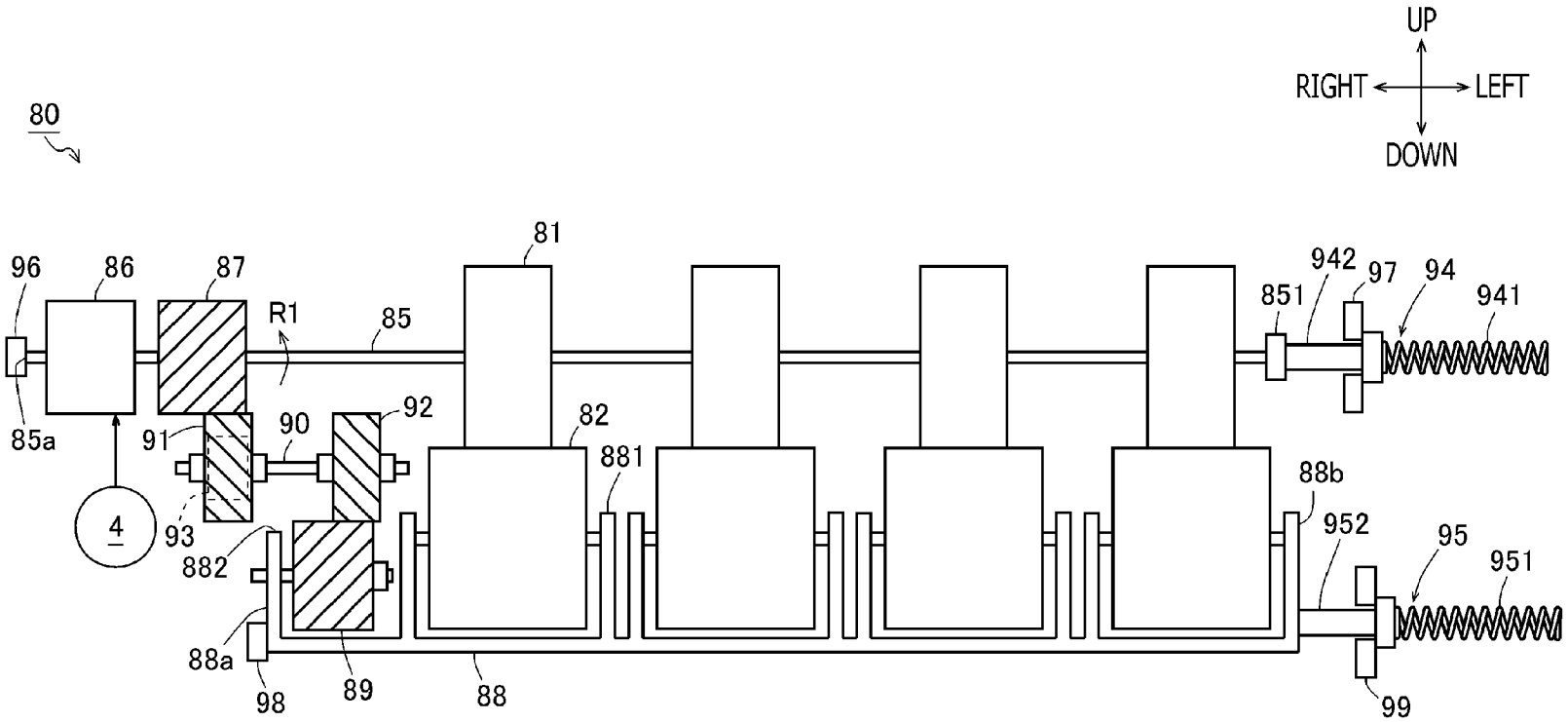
FIG. 2 is a schematic diagram illustrating a configuration of a sorter mechanism in the image forming apparatus according to the illustrative embodiment.
Figure 3:
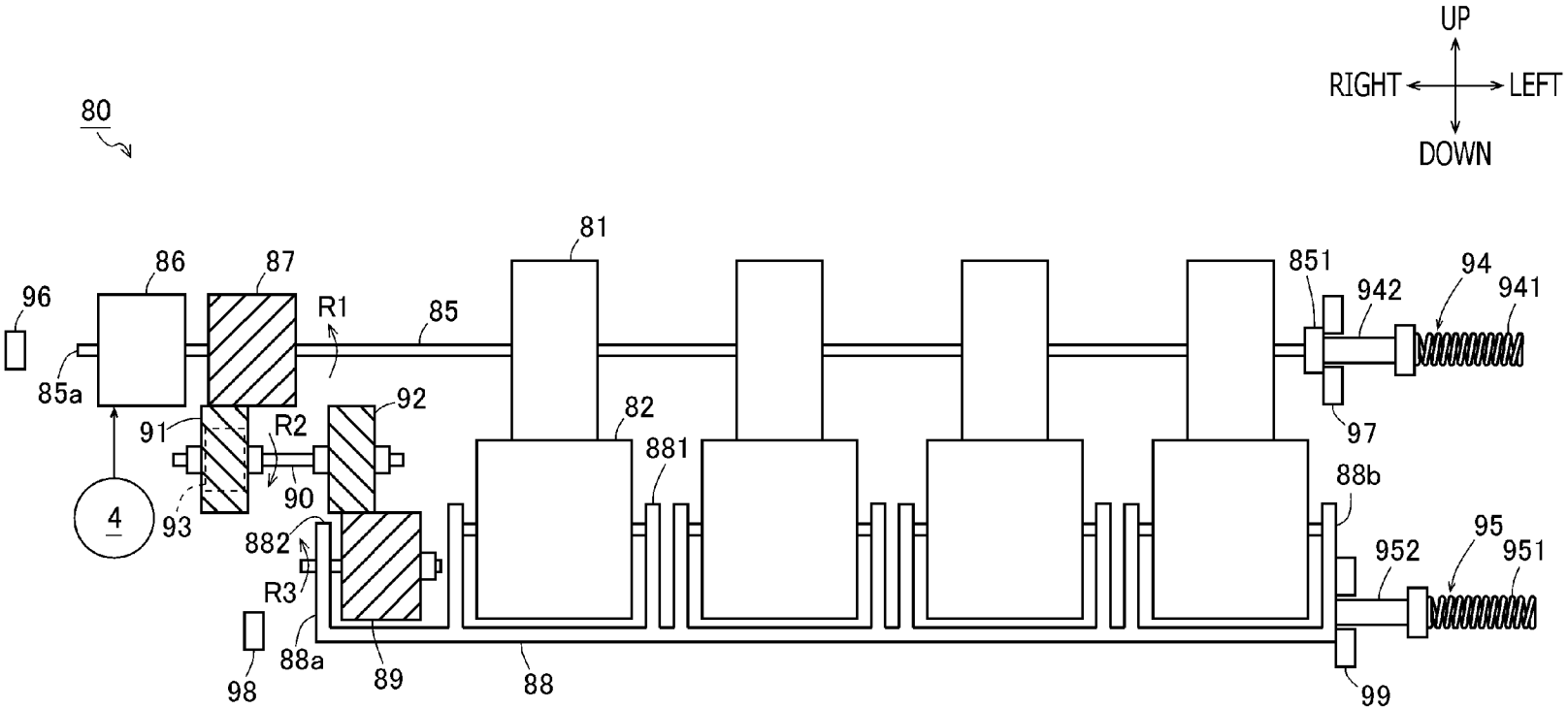
FIG. 3 is a schematic diagram illustrating a configuration of the sorter mechanism in the image forming apparatus according to the illustrative embodiment.

FIG. 2 illustrates a state where the sorter mechanism 80 is in an initial position, and FIG. 3 illustrates a state where the sorter mechanism 80 is in a sorting position. In FIGS. 2 and 3, oblique lines represent the direction of helical teeth. The initial position means a position where the sheet S is discharged without being sorted, and the sorting position means a position where the sheet S is discharged while being sorted.

The sorter mechanism 80 includes, on a $1^{st}$ rotation axis, a $1^{st}$ shaft 85, a drive gear 86, a $1^{st}$ helical gear 87 and four switchback drive rollers 81. Further, the sorter mechanism 80 includes, on a $2^{nd}$ rotation axis which is parallel with the $1^{st}$ rotation axis, a pedestal 88 and switchback rollers 82. The pedestal 88 is provided with a $2^{nd}$ helical gear 89.

Further, the sorter mechanism 80 includes, on a $3^{rd}$ rotation axis which is positioned between the $1^{st}$ rotation axis and the $2^{nd}$ rotation axis and is parallel with the $1^{st}$ rotation axis, a $2^{nd}$ shaft 90, a $3^{rd}$ helical gear 91 and a $4^{th}$ helical gear 92. The $3^{rd}$ helical gear 91 is provided with an electromagnetic clutch 93. Furthermore, the sorter mechanism 80 includes a $1^{st}$ presser member 94 and a $2^{nd}$ presser member 95.

The $1^{st}$ shaft 85 is a rod-like member supporting the switchback drive rollers 81, the drive gear 86 and the $1^{st}$ helical gear 87. The $1^{st}$ shaft 85 is formed to extend in the left and right direction, and is disposed on the $1^{st}$ rotation axis. The $1^{st}$ shaft 85 is rotatable about the $1^{st}$ rotation axis with respect to the housing 2, and is movable in the axis direction, i.e., the left and right direction. A right end part 85*a* of the $1^{st}$ shaft 85 can be in contact with a right contact part 96 of the housing 2 by moving the $1^{st}$ shaft 85 to the right direction. The $1^{st}$ shaft 85 is provided with a pushing part 851 at a left end of the $1^{st}$ shaft 85. By moving the $1^{st}$ shaft 85 to the left direction, the pushing part 851 can be in contact with a left contact part 97 of the housing 2. Further, the pushing part 851 is pressed to the right direction by the $1^{st}$ presser member 94.

The drive gear 86 is fixed to the $1^{st}$ shaft 85 at a position close to the right end part 85*a* of the $1^{st}$ shaft 85, and rotates about the $1^{st}$ rotation axis by a driving force from the motor 4. In accordance with rotation of the drive gear 86, the $1^{st}$ shaft 85 rotates.

The $1^{st}$ helical gear 87 is fixed to the $1^{st}$ shaft 85 at a position between the drive gear 86 and the switchback roller 81, and rotates about the $1^{st}$ rotation axis in accordance with rotation of the $1^{st}$ shaft 85. The $1^{st}$ helical gear 87 engages with the $3^{rd}$ helical gear 91, and rotates in an R1 direction in the forward rotation mode in which the motor 4 rotates in the forward direction. When torque is generated between the $1^{st}$ helical gear 87 and the $3^{rd}$ helical gear 91, thrust is generated on the $1^{st}$ helical gear 87 in a particular direction along the $1^{st}$ rotation axis. In this illustrative embodiment, the direction of the helical teeth of the $1^{st}$ helical gear 87 is designed such that the particular direction in which the thrust acts is the left direction. Since the $1^{st}$ helical gear 87 is fixed to the $1^{st}$ shaft 85, the $1^{st}$ shaft 85 moves to the left direction by the thrust generated on the $1^{st}$ helical gear 87 to the left direction.

The switchback rollers 81 are fixed to the $1^{st}$ shaft 85, and rotate about the $1^{st}$ rotation axis in accordance with rotation of the $1^{st}$ shaft 85.

The pedestal 88 is a supporting member which supports the switchback rollers 82 and the $2^{nd}$ helical gear 89. The pedestal 88 is formed with four pairs of supporting parts 881 which support the switchback rollers 82 rotatably about the $2^{nd}$ rotation axis. At a right end of the pedestal 88, a supporting part 882 which supports the second helical gear 89 is provided.

The pedestal 88 is provided to be movable in the left and right direction, i.e., an axis direction, with respect to the housing 2. A right end 88*a* of the pedestal 88 can be in contact with a right contact part 98 of the housing 2 by moving the pedestal 88 to the right direction. On the other hand, by moving the pedestal 88 to the left direction, a left end part 88*b* of the pedestal 88 can be in contact with a left contact part 99 of the housing 2. The left end part 88*b* is pressed to the right direction by the second presser member 95.

The switchback rollers 82 are disposed such that conveying surfaces for the sheet S of the switchback rollers 82 faces conveying surfaces for the sheet S of the switchback drive rollers 81. The switchback rollers 82 are supported by the pedestal 88 to be rotatable about the $2^{nd}$ rotation axis.

The $2^{nd}$ helical gear 89 is rotatably supported by the pedestal 88. A rotation axis of the $2^{nd}$ helical gear 89 may be the same direction as the $2^{nd}$ rotation axis, and may not be coaxial with the $2^{nd}$ rotation axis. The $2^{nd}$ helical gear 89 engages with the $4^{th}$ helical gear 92, and, in the forward rotation mode in which the motor 4 rotates in the forward direction, the $2^{nd}$ helical gear 89 rotates in R3 direction when torque is generated between the $2^{nd}$ helical gear 89 and the 4th helical gear 92. The helical teeth of the $2^{nd}$ helical gear 89 is configured such that, when the $2^{nd}$ helical gear 89 rotates in the R3 direction (i.e., when the motor 4 rotates in the forward direction), thrust is generated in a particular direction along the $1^{st}$ rotation axis, i.e., thrust to the left direction is generated in this illustrative embodiment. Since the $2^{nd}$ helical gear 89 is supported by the pedestal 88, the pedestal 88 is moved to the left direction by the thrust generated on the $2^{nd}$ helical gear 89 to the left direction.

The $2^{nd}$ shaft 90 is a rod-like member which supports the third helical gear 91 and the $4^{th}$ helical gear 92. The $2^{nd}$ shaft 90 is formed to extend in the left and right direction, and is disposed on the $3^{rd}$ rotation axis. The $2^{nd}$ shaft 90 is rotatable about the $3^{rd}$ rotation axis, and is provided not to move in an axial direction being the left and right direction.

The $3^{rd}$ helical gear 91 is provided close to the right end part of the $2^{nd}$ shaft 90. The $3^{rd}$ helical gear 91 engages with the $1^{st}$ helical gear 87 and thereby rotates about the $3^{rd}$ rotation axis in accordance with rotation of the $1^{st}$ helical gear 87.

The electromagnetic clutch 93 is provided in the $3^{rd}$ helical gear 91. The electromagnetic clutch 93 is a clutch for connecting or disconnecting transmission of the driving force between the $3^{rd}$ helical gear 91 and the $2^{nd}$ shaft 90. That is, the electromagnetic clutch 93 connects or disconnects transmission of the driving force between the $3^{rd}$ helical gear 91 and the $4^{th}$ helical gear 92. When the electromagnetic clutch 93 is connected in the forward rotation mode in which the motor 4 rotates in the forward direction, the $2^{nd}$ shaft 90 rotates in R2 direction. Connection and disconnection of the electromagnetic clutch 93 is controlled by the controller 20.

The $4^{th}$ helical gear 92 is provided at a position close to the left end part of the $2^{nd}$ shaft 90. The $4^{th}$ helical gear 92 rotates about the $3^{rd}$ rotation axis in accordance with rotation of the $2^{nd}$ shaft 90 in a state where the electromagnetic clutch 93 is connected.

The $1^{st}$ presser member 94 includes a compression coil spring 941 disposed to be extendable in the left and right direction, and a pushing member 942 which is provided at the right end part of the compression coil spring 941 and is inserted into a hole formed in the left contact part 97 of the housing 2. The right end part of the pushing member 942 presses, to the right direction, the pushing part 851 of the $1^{st}$ shaft 85 by a restoring force of the compression coil spring 941. The pressing force of the $1^{st}$ presser member 94 is smaller than the thrust generated on the $1^{st}$ helical gear 87.

The $2^{nd}$ presser member 95 includes a compression coil spring 951 disposed to be extendable in the left and right direction, and a pushing member 952 which is provided at the right end part of the compression coil spring 951 and is inserted into a hole formed in the left contact part 99 of the housing 2. The right end part of the pushing member 952 presses, to the right direction, the left end part 88*b* of the pedestal 88. The pressing force of the $2^{nd}$ presser member 95 is smaller than the thrust generated on the $2^{nd}$ helical gear 89.

When the electromagnetic clutch 93 is connected in the sorter mechanism 80 configured as described above, the torque is caused by transmission of the driving force from the motor 4 through the first helical gear 87, the $3^{rd}$ helical gear 91, the $4^{th}$ helical gear 92 and the $2^{nd}$ helical gear 89. By the torque, the thrust is generated on each of the $1^{st}$ helical gear 87 and the $2^{nd}$ helical gear 89 to the left direction along the $1^{st}$ rotation axis. By the thrust, the switchback drive rollers 81 and the switchback roller 82 move to the left direction from the initial position. Through use of movement of the switchback drive rollers 81 and the switchback roller 82, the sorter function is realized.

(Operation of Sorter Mechanism)

Operation of the sorter mechanism 80 will now be explained with reference to FIGS. 2 and 3. When the sheet S being discharged is not to be sorted, the electromagnetic clutch 93 is disconnected. As a result, the sorter mechanism 80 is driven in the state of the initial position shown in FIG. 2, and the sorter mechanism 80 discharges the sheet S. That is, when the driving force from the motor 4 is input to the drive gear 86 in the forward rotation mode in which the motor 4 rotates in the forward direction, the drive gear 86 rotates and thereby the $1^{st}$ shaft 85 rotates in the R1 direction. Then, in accordance with rotation of the $1^{st}$ shaft 85, the $1^{st}$ helical gear 87 and the switchback drive rollers 81 rotate.

The $3^{rd}$ helical gear 91 rotates in accordance with rotation of the $1^{st}$ helical gear 87; however, the driving force is not transmitted from the $3^{rd}$ helical gear 91 to the $2^{nd}$ shaft 90 since the electromagnetic clutch 93 is in the disconnected state. Therefore, torque is not generated between the $1^{st}$ helical gear 87 and the $3^{rd}$ helical gear 91, and thrust is not generated on the 1st helical gear 87. On the other hand, since the pushing part 851 of the $1^{st}$ shaft 85 is pressed to the right direction by the $1^{st}$ presser member 94, the right end part 85*a* of the $1^{st}$ shaft 85 is held at the position where the right end part 85*a* contacts the right contact part 96. Since the $1^{st}$ shaft 85 is held at the initial position where the $1^{st}$ shaft 85 is shifted to the right side, the switchback drive rollers 81 held on the $1^{st}$ shaft 85 are also held at the initial position shifted to the right side.

Since the driving force is not transmitted to the $2^{nd}$ shaft 90, the driving force is not transmitted to the $4^{th}$ helical gear 92 and the $2^{nd}$ helical gear 89. Therefore, no thrust is generated on the $2^{nd}$ helical gear 89. On the other hand, the left end part 88*a* of the pedestal 88 is pressed to the right direction by the $2^{nd}$ presser member 95, the pedestal 88 is held at the position where the right end part 88*a* of the pedestal 88 contacts the right contact part 98 of the housing 2. Since the pedestal 88 is thus held at the initial position shifted to the right side, the switchback rollers 82 held on the pedestal 88 are also held at the initial position shifted to the right side.

Accordingly, the switchback drive rollers 81 and the switchback rollers 82 at the initial position are held in a state where the conveying surfaces of the switchback drive rollers 81 and the conveying surfaces of the switchback rollers 82 face with each other. Consequently, the conveyed sheet S is discharged to the discharge tray 84 while being pinched between the switchback drive rollers 81 and the switchback rollers 82, and is stacked at a position corresponding to the initial position.

When the sheet S being discharged is to be sorted, the electromagnetic clutch 93 is brought to the connected state. As a result, the sorter mechanism 80 operates in the sorting position shown in FIG. 3, and discharges the sheet S. Specifically, when the driving force from the motor 4 is input to the drive gear 86 in the forward rotation mode where the motor 4 rotates in the forward direction, the drive gear 86 rotates and the $1^{st}$ shaft 85 rotates in the R1 direction in accordance with rotation of the drive gear 86. Then, the $1^{st}$ helical gear 87 and the switchback drive rollers 81 rotate in accordance with rotation of the $1^{st}$ shaft 85.

In accordance with rotation of the $1^{st}$ helical gear 87, the $3^{rd}$ helical gear 91 rotates. Since the electromagnetic clutch 93 is in the connected state, the driving force is transmitted from the $3^{rd}$ helical gear 91 to the $2^{nd}$ shaft 90 and the $2^{nd}$ shaft 90 rotates in the R2 direction. Therefore, torque is generated between the $1^{st}$ helical gear 87 and the $3^{rd}$ helical gear 91, and the thrust is generated on the $1^{st}$ helical gear 87 to the left direction. The pressing force of the 1st presser member 94 is smaller than the thrust generated on the $1^{st}$ helical gear 87. Therefore, the driving force generate on the $1^{st}$ helical gear 87 surpasses the pressing force of the $1^{st}$ presser member 94, and the $1^{st}$ shaft 85 moves to the left direction. In this case, the pushing part 851 of the $1^{st}$ shaft 85 pushes the pushing member 942, and thereby the pushing part 851 is held at the position where the pushing part 851 contacts the left contact part 97 of the housing 2. Since the $1^{st}$ shaft 85 is thus held at the sorting position shifted to the left side, the switchback rollers 81 supported on the $1^{st}$ shaft 85 are also held at the sorting position shifted to the left side.

Since the driving force is transmitted to the $2^{nd}$ shaft 90, the driving force is transmitted to the $4^{th}$ helical gear 92 and the $2^{nd}$ helical gear 89. In this case, the $2^{nd}$ helical gear 89 rotates in the R3 direction, and thereby the thrust is generated on the $2^{nd}$ helical gear 89 to the left direction. The pressing force of the $2^{nd}$ presser member 95 is smaller than the thrust generated on the $2^{nd}$ helical gear 89. Therefore, the thrust generated on the $2^{nd}$ helical gear 89 surpasses the pressing force of the $2^{nd}$ presser member 95, and the pedestal 88 on which the $2^{nd}$ helical gear 89 is supported moves to the left direction. In this case, the left end part 88*b* of the pedestal 88 pushes the pushing member 952 to the left direction, and the left end part 88*b* is held at the position where the left end part 88*b* contacts the left contact part 99 of the housing 2. Since the pedestal 88 is thus held at the sorting position shifted to the left side, the switchback rollers 82 supported on the pedestal 88 are also held at the sporting position shifted to the left side. It should be noted that the $1^{st}$ shaft 85 and the pedestal 88 move by the same amount.

Accordingly, the switchback drive rollers 81 and the switchback rollers 82 at the sorting position are held in a state where the conveying surfaces of the switchback drive rollers 81 and the conveying surfaces of the switchback rollers 82 face with each other. While the conveyed sheet S is pinched only by the switchback drive rollers 81 and the switchback rollers 82, the electromagnetic clutch 93 is switched from the disconnected state to the connected state. As a result, the switchback drive rollers 81 and the switchback rollers 82 move from the initial position to the sorting position in a state where the sheet S is pinched by the switchback drive rollers 81 and the switchback rollers 82, and then the sheet S is discharged to the discharge tray 84 at the sorting position. Consequently, the sheet S is stacked at the position shifted to the left direction.

When the electromagnetic clutch 93 is subsequently switched from the connected state to the disconnected state, the thrust on the $1^{st}$ helical gear 87 and the $2^{nd}$ helical gear 89 disappears. Therefore, the $1^{st}$ shaft 85 and the pedestal 88 return from the sorting position to the initial position by the pressing forces of the $1^{st}$ presser member 94 and the $2^{nd}$ presser member 95. That is, the switchback drive rollers 81 and the switchback rollers 82 return to the initial position.

By appropriately combining the discharging operation at the initial position and the discharging operation at the sorting position of the sorter mechanism 80, it becomes possible to realize the sorter function in which the discharging position of the sheet S is shifted in the left and right direction.

(Control Configuration of Sorter Mechanism)

Figure 4:
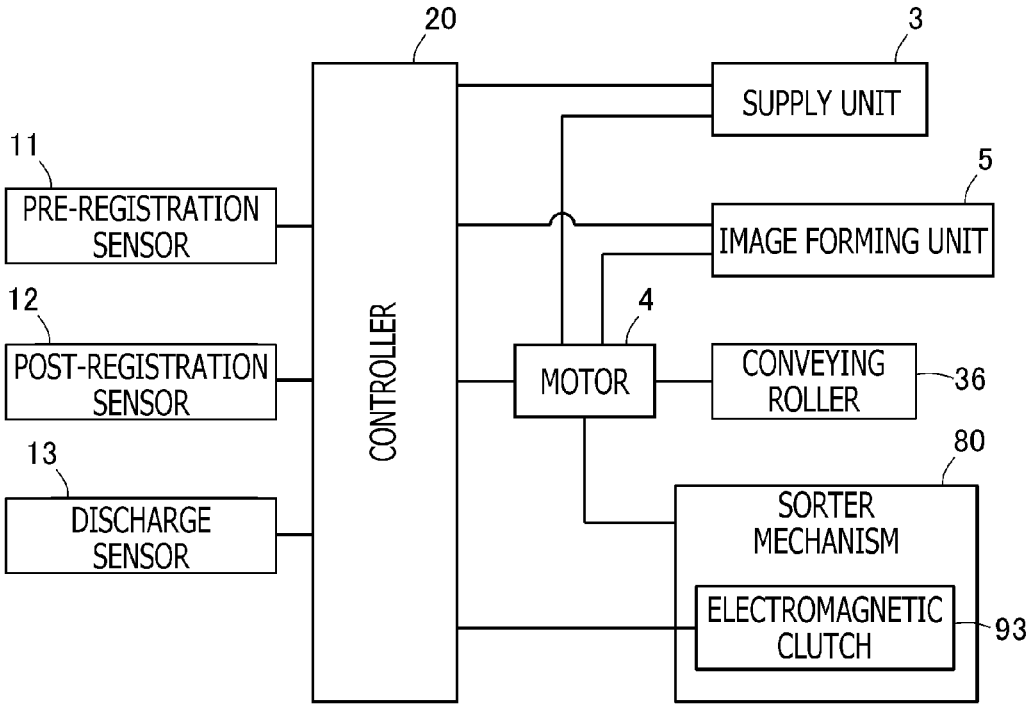
FIG. 4 is a block diagram illustrating a control configuration concerning the sorter function in the image forming apparatus according to the illustrative embodiment.

As shown in FIG. 4, to the controller 20, the pre-registration sensor 11, the post-registration sensor 12, the discharge sensor 13, the supply unit 3, the motor 4, the image forming unit 5, and the electromagnetic clutch 93 are connected. The driving force of the motor 4 is transmitted to the supply nit 3, the image forming unit 5, the conveying roller 36 and the sorter mechanism 80.

By controlling rotation of the motor 4 based on signals output from the pre-registration sensor 11, the post-registration sensor 12 and the discharge sensor 13, the controller 20 performs control for the single side printing and the double side printing. Further, by instructing connection and disconnection of the electromagnetic clutch 93 based on a signal output from the discharge sensor 13, the controller 20 controls the sorter function.

(Operation of Sorter Function)

Figure 5:
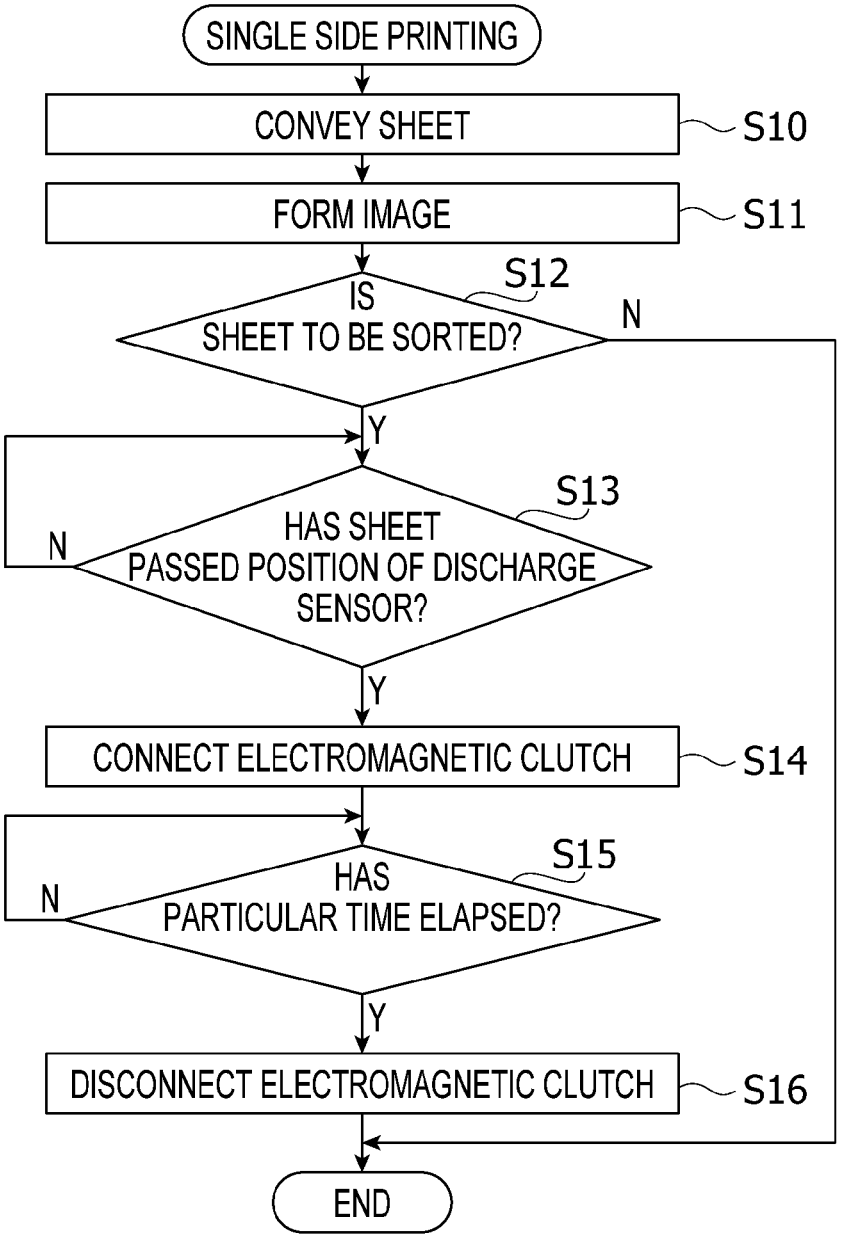
FIG. 5 is a flowchart illustrating operation when the sorter function is performed in single side printing in the image forming apparatus according to the illustrative embodiment.

Operation of the sorter function for the single side printing shown in FIG. 5 is performed under control of the controller 20. In step S10, the sheet S stacked on the sheet cassette 30 is conveyed to the image forming unit 5. Then, an image is formed on the sheet S in the image forming unit 5 (step S11). Next, the controller 20 determines whether to sort the sheet S (step S12). Whether to sort the sheet S may be determined based on whether or not a separation for each print job is found.

When the controller 20 determines to sort the sheet S in step S12, the process proceeds to step S13 where the controller 20 determines whether the sheet S has passed a position of the discharge sensor 13. When the discharge sensor 13 detects absence of the sheet S after the discharge sensor 13 has detected presence of the sheet S, it can be determined that the trailing edge of the sheet S has passed the discharge sensor 13. Therefore, it can be determined that the trailing edge of the sheet S has passed the conveying roller 37 after a particular time has elapsed from a time when the discharge sensor 13 has detected absence of the sheet S. In this case, the particular time may be determined based on the distance and the conveying speed between the discharge sensor 13 and the conveying roller 37. When the controller 20 determines that the particular time has elapsed from a time when the discharge sensor 13 has detected absence of the sheet S, the controller 20 regards the sheet S as being in the state of being pinched between the switchback drive roller 81 and the switchback roller 82. Then, the process proceeds to step S14 where the controller 20 controls the electromagnetic clutch 93 to switch from the disconnected state to the connected state. As a result, the sheet S is discharged to the discharge tray 84 while being shifted to the left direction.

Then, the process proceeds to step S15 where the controller 20 determines whether a particular time has elapsed from a time where the electromagnetic clutch 93 has been switched to the connected state. In this case, the particular time is a time required for the trailing edge of the sheet S to pass the switchback drive roller 81, and may be preliminary set.

When the controller 20 determines in step S15 that the particular time has elapsed, the process proceeds to step S16 where the controller 20 controls the electromagnetic clutch 93 to switch from the connected state to the disconnected state. As a result, it becomes possible to sort the next sheet S.

On the other hand, when the controller 20 determines that the sheet S is not to be sorted (S12: NO), the sheet S is discharged to the discharge tray 84 in the state where the electromagnetic clutch 93 is in the disconnected state. As a result, the sheet S is discharged to the position on the right side with respected to the sorting position.

Figure 6:
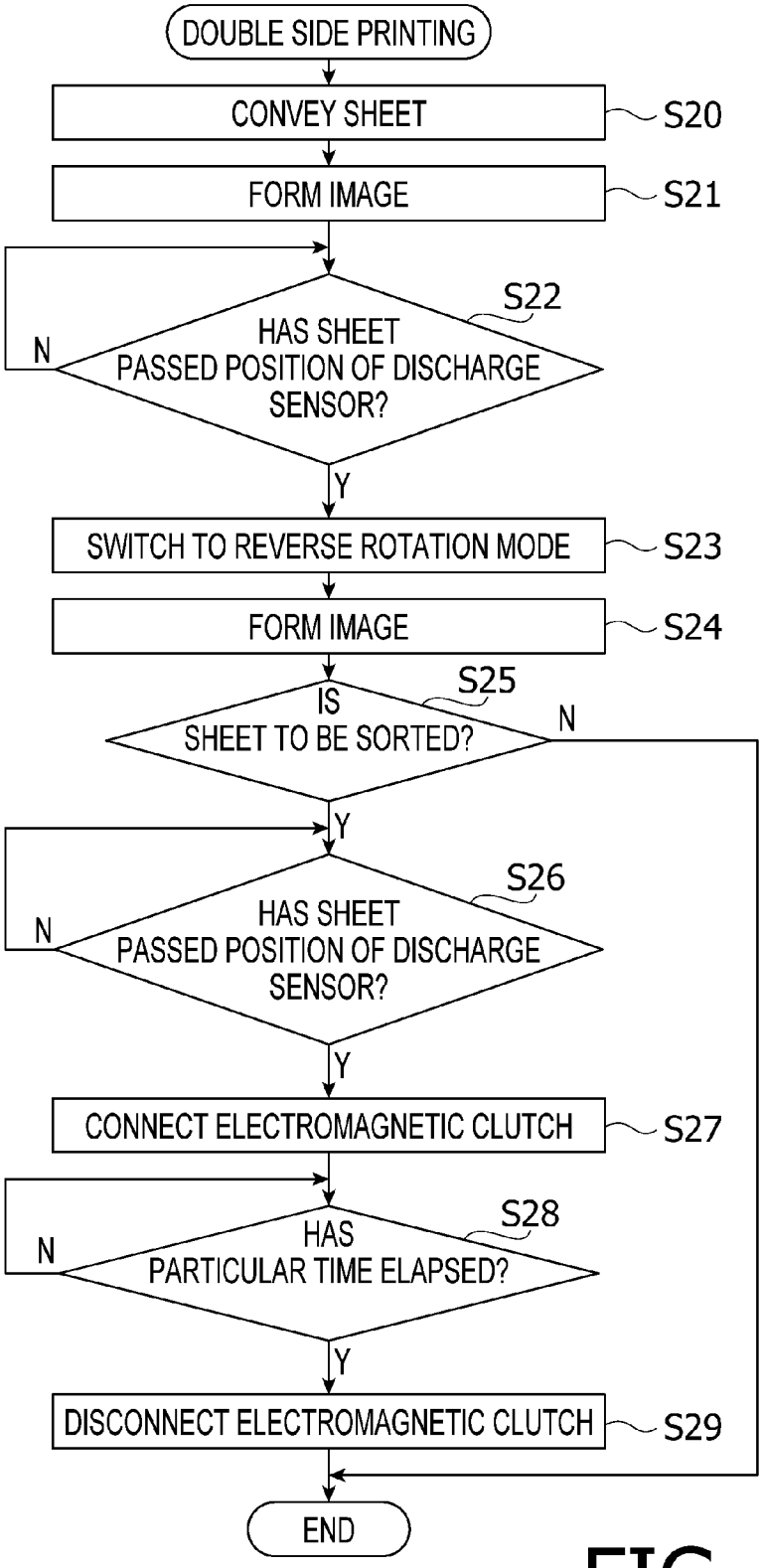
FIG. 6 is a flowchart illustrating operation when the sorter function is performed in double side printing in the image forming apparatus according to the illustrative embodiment.

Operation of the sorter function for double side printing shown in FIG. 6 is performed under control of the controller 20. In step S20, the sheet S stacked on the sheet cassette 30 is conveyed to the image forming unit 5. Then, an image is formed on one side of the sheet S in the image forming unit 5 (step S21). Next, the controller 20 checks the state of the discharge sensor 13 to determine whether the sheet S has passed the position of the discharge sensor 13. As described above, when the controller 20 determines that a particular time has elapsed from a time when the discharge sensor 13 has detected absence of the sheet S, the controller 20 regards the sheet S as being in the state of being pinched between the switchback drive roller 81 and the switchback roller 82.

When the controller 22 determines in step S22 that the sheet S has passed the position of the discharge sensor 13 (S22: YES), the process proceeds to step S23 where the controller 20 switches the mode from the forward rotation mode to the reverse rotation mode. As a result, the switchback drive roller 81 rotates in the reverse direction, and the sheet S is conveyed to the reverse path L2 and is reversed. Then, the sheet S is re-conveyed to the image forming unit 5.

When the sheet S is thus re-conveyed to the image forming unit 5, the controller 20 switches the mode from the reverse rotation mode to the forward rotation mode, and the image forming unit 5 forms an image on the other side of the sheet S. Next, in step S25, the controller 20 determines whether to sort the sheet S.

When the controller 20 determines to sort the sheet S (S25: YES), the process proceeds to step S26 where the controller 20 checks the state of the discharge sensor 13 to determine whether the sheet S has passed the position of the discharge sensor 13 in the same manner as step S22. Furthermore, in step S26, by detecting that the same sheet S has passed the conveying roller 37 two times, the controller 20 determines that the double side printing has been performed. Then, the process proceeds to step S27 where the controller 20 controls the electromagnetic clutch 93 to switch from the disconnected state to the connected state. As a result, the sheet S is discharged to the discharge tray 84 while being shifted to the left direction.

Next, in step S28, the controller 20 determines whether a particular time has elapsed from a time when the electromagnetic clutch 92 has been switched to the connected state. When the controller 20 determines in step S28 that the particular time has elapsed, the process proceeds to step S29 where the controller 20 controls the electromagnetic clutch 93 to switch from the connected state to the disconnected state. As a result, it becomes possible to sort the next sheet S being conveyed.

On the other hand, when the controller 20 determines that the sheet S is not to be sported (S25: NO), the sheet S is discharged to the discharge tray 84 in the state where the electromagnetic clutch 93 is in the disconnected state. As a result, the sheet S is discharged, on the discharge tray 84, to the initial position which is on the right side with respect to the sorted position.

According to the above described operation of the sorting function, the motor 4 is not stopped or rotated in the reverse direction in order to perform the sorter function. That is, the sorter function can be realized in the same conveying direction and the same conveying time as those defined when the sorter function is not performed.

(Variations)

In the above described illustrative embodiment, the $1^{st}$ shaft 85 being a rod-like member is used as a support part for the $1^{st}$ helical gear 87 and the switchback drive rollers 81. However, another type of support part, such as a pedestal, may be used to support the $1^{st}$ helical gear 87 and the switchback drive rollers 81. In the above described illustrative embodiment, the pedestal 88 is used as a support part for the $4^{th}$ helical gear 89 and the switchback rollers 82. However, another type of support part, such as a shaft, may be used to support the $4^{th}$ helical gear 89 and the switchback rollers 82.

In the above described illustrative embodiment, compression coil springs are used as the first presser member 94 and the second presser member 85; however, another type of elastic member, such as rubber, may be used as the first presser member 94 and the second presser member 95.

In the above described illustrative embodiment, the electromagnetic clutch 93 is used as a clutch; however, another type of clutch, such as a claw clutch or a fluid clutch may be used in place of the electromagnetic clutch 93.

(Advantageous Effects of the Illustrative Embodiment)

According to the image forming apparatus 1 of the above described illustrative embodiment, the sheet conveyer includes the switchback drive rollers 81 rotating about the 1st rotation axis by the driving force of the motor 4, and the $1^{st}$ shaft 85 supporting the switchback drive rollers 81. Furthermore, the sheet conveyer includes the $1^{st}$ helical gear 87 which rotates about the $1^{st}$ rotation axis together with the switchback drive rollers 81 and generates the thrust on the $1^{st}$ shaft 85 in the particular direction along the $1^{st}$ rotation axis. Furthermore, the sheet conveyer includes the switchback rollers 82 which are disposed at the position, at which the conveying surfaces of the switchback rollers 82 face the conveying surfaces of the switchback drive rollers 81, and are rotatable about the $2^{nd}$ rotation axis parallel with the $1^{st}$ rotation axis, and the pedestal 88 supporting the switchback roller 82. Furthermore, the sheet conveyer includes the $2^{nd}$ helical gear 89 which generates the thrust on the pedestal 88 in the particular direction. Furthermore, the sheet conveyer includes the $3^{rd}$ helical gear 91 which engages with the $1^{st}$ helical gear 87, the $4^{th}$ helical gear 92 which engages with the $2^{nd}$ helical gear 89, and the electromagnetic clutch 93 which connects or disconnects transmission of the driving force between the $3^{rd}$ helical gear 91 and the $4^{th}$ helical gear 92. When the electromagnetic clutch 93 is disconnected, the switchback driver rollers 81 and the switchback rollers 82 are disposed at the initial position. When the electromagnetic clutch 93 is connected, the switchback drive rollers 81 and the switchback rollers 82 are shifted to the particular direction from the initial position.

With this configuration, when the electromagnetic clutch 93 is connected, the driving force is transmitted, from the motor 4, via the $1^{st}$ helical gear 87, the $3^{rd}$ helical gear 91, the $4^{th}$ helical gear 92, and the $2^{nd}$ helical gear 89, and thereby torque is caused. By the torque, the thrust is generated along the $1^{st}$ rotation axis on each of the $1^{st}$ helical gear 87 and the $2^{nd}$ helical gear 89. By the thrust, the $1^{st}$ shaft 85 supporting the switchback rollers 81 moves. As a result, in the sheet conveyer, the switchback drive rollers 81 and the switchback rollers 82 move from the initial position in the particular direction. Therefore, with the above described simple configuration in which helical gears are used, it becomes to shift the sheet in the same conveying direction and the same required time as those in the case where the sheet is not shifted, without the need for reversing the motor 4 to shift the sheet.

According to the image forming apparatus 1 of the above described illustrative embodiment, the sheet conveyer includes the $1^{st}$ presser member which presses, with a force smaller than the thrust generated on the $1^{st}$ shaft 85, the $1^{st}$ shaft 85 in the opposite direction with respect to the particular direction in which the $1^{st}$ shaft 85 is moved by the thrust. With this configuration, it becomes possible to return the switchback rollers 81 to the initial position when the electromagnetic clutch 93 is brought to the disconnected state from the connected state.

According to the image forming apparatus 1 of the above described illustrative embodiment, the sheet conveyer includes the $2^{nd}$ presser member 95 which presses, with a force smaller than the thrust generated on the $2^{nd}$ helical gear 89, the pedestal 88 in the opposite direction with respect to the particular direction in which the pedestal 88 is moved by the thrust. With this configuration, it becomes possible to return the switchback rollers 82 to the initial position when the electromagnetic clutch 93 is brought to the disconnected state from the connected state.

The image forming apparatus 1 according to the above described illustrative embodiment includes the discharge sensor 13, the image forming unit 5 provided on the conveying path of the sheet, and the controller 20. The controller 20 instructs connection for the electromagnetic clutch 93 in response to the fact that the particular time has elapsed from the time when the discharge sensor 13 detects absence of the sheet after detecting presence of the sheet. Consequently, the sorter function is realized.

The image forming apparatus 1 according to the illustrative embodiment includes the conveying roller 37 provided on the upstream side in the conveying direction with respect to the switchback drive roller 81, and the discharge sensor 13 which detects that the sheet has passed the conveying roller 37. The image forming apparatus 1 includes the image forming unit 5 provided on the upstream side in the conveying direction with respect to the conveying roller 37, and the controller 20. The controller 20 instructs connection for the electromagnetic clutch 93 in response to the fact that the discharge sensor 13 has detected that the sheet has passed the conveying roller 37 two times during the double side printing in which the sheet passed the conveying roller 37 is reversed by the reverse rotation of the switchback roller 81. With this configuration, the sorter function in the double side printing is realized.

What is claimed is:

1. A sheet conveyer, comprising:

a 1st conveying roller configured to rotate about a 1st rotation axis by a driving force from a driving source;

a 1st support part configured to support the 1st conveying roller;

a 1st helical gear configured to rotate about the 1st rotation axis together with the 1st conveying roller and to generate thrust, on the 1st support part, in a particular direction along the 1st rotation axis;

a 2nd conveying roller disposed at a position where a conveying surface of the 2nd conveying roller faces a conveying surface of the 1st conveying roller, the 2nd conveying roller being configured to be rotatable about a 2nd rotation axis parallel with the 1st rotation axis;

a 2nd support part configured to support the 2nd conveying roller;

a 2nd helical gear configured to generate thrust, on the 2nd support part, in the particular direction;

a 3rd helical gear configured to engage with the 1st helical gear;

a 4th helical gear configured to engage with the 2nd helical gear; and a clutch configured to connect or disconnect transmission of a driving force between the 3rd helical gear and the 4th helical gear, wherein:

when the clutch disconnects transmission of the driving force between the 3rd helical gear and the 4th helical gear, the 1st conveying roller and the 2nd conveying roller are disposed at an initial position, when the clutch connects transmission of the driving force between the 3rd helical gear and the 4th helical gear, the 1st conveying roller and the 2nd conveying roller move from the initial position in the particular direction.

2. The sheet conveyer according to claim 1, further comprising a presser member configured to press the 1st support part in an opposite direction with respect to the particular direction by a force smaller than the thrust generated by the 1st helical gear.

3. The sheet conveyer according to claim 1, further comprising an additional presser member configured to press the 2nd support part in an opposite direction with respect to the particular direction by a force smaller than the thrust generated by the second helical gear.

4. An image forming apparatus, comprising:

a sheet conveyer according to claim 1;

a sensor provided on a conveying path for a sheet;

an image forming unit provided on the sheet conveying path; and a controller, wherein the controller is configured to instruct connection of the clutch in response to a fact that a particular time has elapsed from a time when the sensor detects that the sheet has passed a position of the sensor.

5. An image forming apparatus, comprising:

a sheet conveyer according to claim 1;

a 3rd conveying roller provided on an upstream side in a conveying direction with respect to the 1st conveying roller;

a sensor configured to detect that a sheet has passed the 3rd conveying roller;

an image forming unit provided on an upstream side in the conveying direction with respect to the 3rd conveying roller; and a controller, wherein, during double side printing in which the sheet passed the 3rd conveying roller is reversed and is re-conveyed to the image forming unit by a reverse rotation of the 1st conveying roller, the controller instructs connection of the clutch in response to a fact that the sensor detects that the sheet has passed the 3rd conveying roller two times.

* * * * *